United States Patent [19]

Longley, Jr.

[11] Patent Number: 4,532,910

[45] Date of Patent: Aug. 6, 1985

[54] PORTABLE, KNOCKDOWN FIELD STOVE

[76] Inventor: James B. Longley, Jr., P.O. Box 1230, 671 Main St., Lewiston, Me. 04240

[21] Appl. No.: 652,270

[22] Filed: Sep. 20, 1984

[51] Int. Cl.[3] ..... F24C 1/16

[52] U.S. Cl. ..... 126/9 B; 126/29; 126/30; 126/38; 248/165

[58] Field of Search ..... 126/9 R, 9 A, 9 B, 29, 126/30, 38, 43, 59, 279, 333; 248/150, 152, 165, 174

[56] References Cited

U.S. PATENT DOCUMENTS

| | | | |
|---|---|---|---|
| 163,202 | 5/1875 | Houston | 248/150 |
| 673,965 | 5/1901 | Ringenberg | 126/30 |
| 781,758 | 2/1905 | Annin | 126/30 |
| 889,187 | 6/1908 | Ball | 126/59 |
| 961,975 | 6/1910 | Long | 126/30 |
| 1,096,002 | 5/1914 | Stopple | 126/29 |
| 1,102,649 | 7/1914 | Dix | 126/29 |
| 1,221,514 | 4/1917 | Crain | 126/29 |
| 1,238,142 | 8/1917 | Hitchcock | 126/29 |
| 1,273,840 | 7/1918 | Fassett | 248/165 |
| 1,569,401 | 1/1926 | Sims | 126/30 |
| 2,022,291 | 11/1935 | Lehman | 248/165 |
| 2,058,836 | 10/1936 | Silver | 126/29 |
| 2,335,020 | 11/1943 | Nehrich | 126/43 |
| 2,467,480 | 4/1949 | Hudson | 126/9 B |
| 2,469,885 | 5/1949 | Molla | 126/9 B X |
| 2,575,188 | 11/1951 | Schell | 126/9 B |
| 2,592,561 | 4/1952 | Greenwood | 248/48 |
| 2,627,263 | 2/1953 | Anderson | 126/43 X |
| 2,631,579 | 3/1953 | Metzger | 126/29 |
| 2,965,097 | 12/1960 | Clark | 126/30 |
| 3,447,530 | 6/1969 | Santeramo | 126/9 R X |
| 3,589,353 | 6/1971 | Sanders | 126/9 A |
| 3,625,195 | 12/1971 | Grall | 126/9 A |
| 3,727,979 | 4/1973 | Schier et al. | 126/9 A X |
| 3,841,298 | 10/1974 | Sellors | 126/9 A |
| 4,186,716 | 2/1980 | Baker et al. | 126/29 |
| 4,385,619 | 5/1983 | Casinelli | 126/9 B |

*Primary Examiner*—Margaret A. Focarino
*Attorney, Agent, or Firm*—Terry M. Gernstein

[57] ABSTRACT

A portable, knockdown field stove (10) is formed of a plurality of elongated plates (16*a*, 16*b*, 16*c*) interlocked by triangular notches (30, 32) defined therein. The plates tilt to be downwardly convergent toward the ground to support a portable heat source (14) and a utensil (2) above the ground on the plates. Ventilation for the heat source is established through the notches past the interlocked plates. Various other peripheral shapes for the stove (50, 68, 80) can also be formed.

7 Claims, 7 Drawing Figures

PORTABLE, KNOCKDOWN FIELD STOVE

TECHNICAL FIELD

The present invention relates, in general, to cooking equipment, and more particularly, to portable field stoves.

BACKGROUND ART

Heating food and fluids in the field has always presented problems to campers and hikers. These people have only limited space and weight whigh can be devoted to their cooling needs, yet such needs are essential and may be critical if the person is subject to severe environmental conditions and has a possibility of being cut off from supplies or from support areas. These problems must be solved, yet cannot be solved using equipment which is unduly expensive or which creates problems in the field.

Heating and cooking devices for use by campers, or the like, should be easily transported in a form which does not require a great deal of space and which is not unduly heavy. Yet, at the same time, these devices should be sturdy even in severe weather and terrain conditions, as a stove or grill collapsing into a campfire can be dangerous. These requirements are made even more difficult by a further requirement that such devices can be easily and quickly assembled and disassembled in the field so that camp set-up and break-up can be efficiently and conveniently carried out by all, even those whose dexterity is impaired for some reason, such as by heavy gloves, or the like.

Cost is a further consideration for these devices. Thus, while satisfying all of the above requirements, a successful device of this type should not be difficult or costly to manufacture or be unduly expensive to the consumer. Cost is a consideration for nearly all devices in this area; however, because presently available devices do not satisfy the above-mentioned requirements while still being usable by a wide variety of people under wide variety of conditions, these known devices can be considered as being expensive. Furthermore, if there are a multiplicity of parts, or if the parts of a device are not easily replaced, or if an entirely new unit is required if one element of a unit is damaged or lost, the units are expensive.

Efficient use of fuel is another important consideration. If fuel is burned too quickly, fuel costs are high, yet if fuel is burned too slowly, cooking time is too slow. If fuel cannot be readily replenished, it becomes very important to properly ventilate the device for the most efficient fuel consumption. In conjunction with this requirement is the requirement that certain foods be kept closer to the heat source than others for efficient cooking. To be more efficient, it is desirable that such devices be amenable to use with a wide variety of cooking and heating utensils. While many known devices have a heating area large enough to hold nearly any utensil carried by a camper, such devices make inefficient use of fuel when a small utensil is heated.

Another important consideration for such equipment is adaptability for use under a variety of environmental conditions. Thus, a person may camp in maintainous terrain, in windy areas, or even on snow or ice-covered terrain such as Arctic environments. It is desirable to have one single device which can function reliably and efficiently under all of these conditions. Because military personnel are often located in remote areas which may be cut off from sources of supply, all of the above-mentioned requirements are present and elevated from mere requirements to critical needs for military personnel. Furthermore, military personnel must be highly mobile and able to make camp and break camp quickly. In addition to the above requirements, the change from canned rations to dried rations in both civilian and military areas has created new problems. In the past, a canteen cup such as used by the military could be used as a container in which to heat fluids or rations. While convenient and effective, the canteen cup still must be placed over a heat source to effect this heating.

With canned rations, certain foods, such as crackers, for example, were stored in cans. Once opened, these cans provided a convenient field stove in which a portable heat source could be placed to heat a canteen cup, or other food storage can resting on top of the can. Furthermore, food in such rations was often stored in fluid and thus could be heated or cooked in a convenient manner over such a temporary field "stove."

This system of forming field stoves worked well until the rations system in both the civilian and the military areas was converted from cans to ready-to-eat freeze dried and pouched foods. This conversion realizes many advantages over the canned food ration system but also creates several problems for the person in the field. First, the use of dried and pouched foods creates a requirement for additional water to replace the fluid heretofore present in the canned foods, such fluid being both a cooking medium and a consumable fluid. Second, the removal of the can itself eliminated the herein above-mentioned heat source containing used in conjunction with a canteen cup to form a portable field stove.

The above-described canteen cup/ration can/portable "stove" was quite satisfactory. It had the additional advantage of being cost-effective as no special equipment was needed. As no known field stove is capable of satisfying all of the above-mentioned requirements and particularly the stringent military requirement, the known devices have not found wide acceptance.

While portable stoves and grills for civilian use have been known for many years, see U.S. Pat. No. 1,096,002, and for military use, see U.S. Pat. No. 889,187, such devices are not adequate for modern use which has the above-mentioned requirements.

For example, portable grills such as those disclosed in U.S. Pat. Nos. 3,636,938; 3,975,999 and 4,186,716 all require some element such as a rock or the like, to support the grill over a heat source. As civilians and military personnel are often located in areas devoid of such supports, these grills may be nearly useless in such applications.

Devices such as that disclosed in U.S. Pat. Nos. 1,273,840 and 1,309,049 have support legs and thus overcome the just-mentioned problem. However, these devices, like the above-mentioned devices, do not protect the heat source, and therefore are not suitable for use in severe weather conditions of high winds, rain, or the like.

While portable devices such as those disclosed in U.S. Pat. Nos. 781,758; 961,975; 1,507,959 and 2,631,579 have structure for supporting the grill as well as for protecting the heat source, these devices are not durable and require many different elements to assemble and disassemble thereby making them costly, cumbersome and difficult to assemble. As such, these devices also are not entirely satisfactory for use which requires portability and durability in an easily assembled device.

U.S. Pat. Nos. 1,102,649 and 1,238,142 disclose devices which are sturdy, durable, easily transported, yet require the heat source to be placed on the ground. Still further, there is no way to vary the position of the heat source with respect to the cooking utensil for establishing efficient cooking rates or for varying the amount of ventilation to the heat source to account for wind conditions or to establish various burn rates for the heat source. While these devices may be suitable for many purposes, they are unsuitable for use on snow or ice. Furthermore, both of these devices include hinges which must be assembled during manufacture, thereby increasing the cost of the unit, and which are subject to malfunctioning in the field.

U.S. Pat. No. 3,625,195 discloses a device which supports the heat source, yet which is cumbersome to transport, may be difficult to set-up, and may not be reusable as it is intended to be disposable. While such a device is suitable for cookouts, it is not entirely satisfactory for hikers, military personnel or the like.

U.S. Pat. No. 163,202 discloses a portable cooking device which includes legs and an enclosed heat source, and therefore overcomes many of the drawbacks identified for the above-discussed devices. However, in the Houston device, the structure serving as the supporting element includes unique elements which are different from each other and also different from the structure serving as the heat source enclosure. Therefore, the Houston device is cumbersome to store and carry, and should one of these structural elements be lost, the entire device may be rendered essentially useless until that precise element or the entire unit is replaced.

None of the above devices are entirely suitable for use with a variety of different utensils. A large utensil may restrict air flow to and from the heat source via the top of the device, while a small utensil may permit too much ventilation thereby wasting heat. U.S. Pat. No. 2,965,097 discloses a device which is adjustable in size. However, the heat source used by this device rests on the ground, and thus the device suffers from the above-discussed drawbacks.

DISCLOSURE OF THE INVENTION

It is a main object of the present invention to provide a novel and improved portable, knockdown field stove which is usable in a wide variety of weather and terrain conditions which is effective and which uses fuel in an efficient manner.

It is another object of the present invention to provide a novel and improved portable, knockdown field stove which can provide different rates of fuel consumption and utensil heating.

It is another object of the present invention to provide a novel and improved portable, knockdown field stove which can be formed using a minimum number of elements to be light-weight and easy to assemble. The stove elements are compact and can be folded flat and easily carried in a shirt pocket, yet will be very stable when assembled.

It is another object of the present invention to provide a novel and improved portable, knockdown field stove which is adjustable and adaptable for uses with a plurality of different utensils and fuel sources and is adapted to assume a plurality of different peripheral shapes and different relative orientations of the components thereof for permitting the plates to be interlocked to form the field stove and for permitting the plates to be disengaged from each other to knock down the stove. The elements of the stove are inexpensive and easy to manufacture so they can be disposable if desired. The stove can thus be adjusted to accommodate various utensils and also to accommodate heat sources of various sizes and shapes.

It is another object of the present invention to provide a novel and improved portable, knockdown field stove which is amenable for military use.

It is another object of the present invention to provide a knockdown stove which is sturdy and stable in the set-up configuration. The elements forming the stove plates have notches defined in them. The notches are sized and shaped so that interlocked plates will be angled with respect to each other to not only support heat sources of various sizes and shapes above the ground, but to also resolve the forces generated by the weight of any utensil supported on the stove so that such forces increase the force tending to lock the plates together. The assembled stove is thus self-tightening.

These and other objects are accomplished by the present invention which is embodied in a portable, knockdown field stove comprising a plurality of plates each of which includes triangular notches in the side edges thereof. The triangular shape of the notches permits interlocked plates to tilt to form a truncated pyramid which converges downwardly toward the ground. The downward convergence of the plates permits a heat source to be supported on the plates above the ground and increases interlocking forces as weight supported on the stove increases. The notches also provide a space between interlocked plates which forms a ventilation path for a heat source located inside the field stove on the interlocked plates. When the plates are interlocked in this manner, the vents formed at the notches are also protected from the wind. By using various numbers of plates, field stoves of various sizes and shapes can be formed so that a proper ventilating clearance between a utensil supported on the stove and the plates can be formed for utensils of various sizes and shapes. The plates can be identical for ease of manufacture and use, and can form an open or closed bottom for the stove.

BEST MODE FOR CARRYING OUT THE INVENTION

Figure 1:
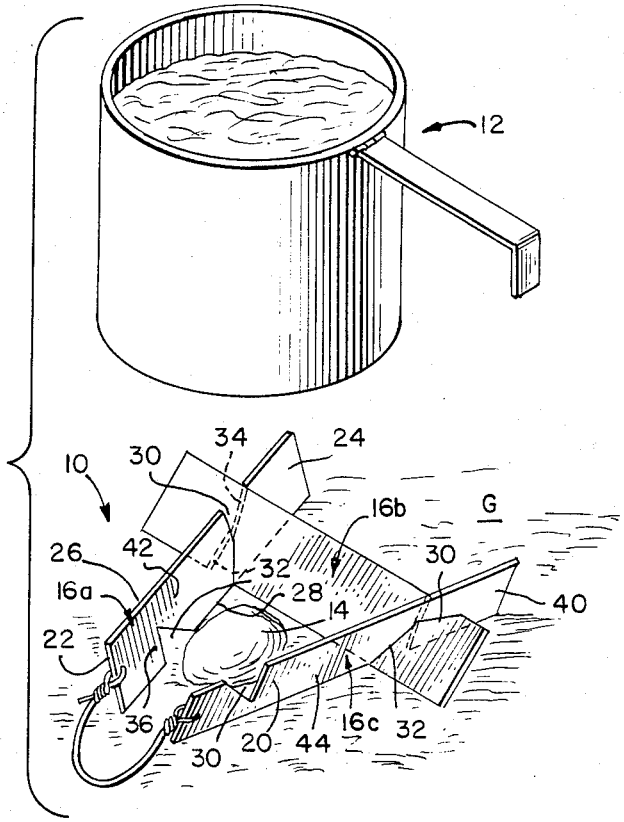
FIG. 1 is an exploded perspective of a portable, knockdown field stove embodying the present invention.

Shown in FIG. 1 is a portable, knockdown field stove 10 for supporting a utensil, such as a canteen cup 12, above a portable heat source, such as a fuel tab 14. The field stove 10 is formed of three identical, elongated plates 16*a*, 16*b* and 16*c* which converge toward each other at the bottom for supporting a fuel source thereon and diverge from each other at the top. The plates are interlocked to enclose the heat source and support both the heat source and the cooking utensil above the ground G while also providing proper ventilation to the heat source through the joints of the stove and past the cooking utensil.

Each plate includes a rectangular body 20 having end edges 22 and 24 connected together by side edges 26 and 28. Notches 30 and 32 are formed in side edges 26 and 28 respectively and, in the FIG. 1 embodiment are in the form of right triangles, with notch 30 having a hypotenuse 34 thereof adjacent to end edge 24, with notch 32 having leg 36 adjacent to end edge 22. End sections 40 are located between the notches and the end edges of the plates.

The plates are identical and the notches are oriented and positioned so that, notch 30 of one plate engages notch 32 of another plate whereby plate end sections 40 extend beyond the joint formed between the plates to act as a wind shield and the plates tilt to be downwardly convergent toward the ground. Thus, for example, plate 16*a* is joined to plate 16*b* at a joint formed by notch 30 of plate 16*a* and notch 32 of plate 16*b*. Thus positioned, each plate has an inner surface 42 (shown on plate 16*a*) and as well as an outer surface 44 (shown on plate 16*c*) which rests on a hypotenuse of the adjacent plate. The plates and notches are designed so that interlocked plates are angled with respect to each other whereby forces generated by weight placed on the stove are directed and resolved so that the plate interlocking forces are increased by such weight. The stove therefore can be said to be self-tightening, in other words, the stove will increase its stability in proportion to the amount of weight supported thereby. The stove uses the weight supported thereon to increase the tightening ability thereof.

The depth of each notch as measured from the corresponding side edge of the plate toward the other side edge of the plate, is selected to establish the desired degree of tilt and the relative spacing for the plates to the stove 10. The tilt is selected according to the size and weight of the utensil, or utensils, supported on the stove and the size and shape of the heat source. The "width" of each notch, as measured along the corresponding plate side edge from one leg to the hypotenuse, is selected to establish the desired amout of ventilation for the enclosed heat source. The "width" of each notch can be influenced by the size of the opening between the utensil and the plates so the total air flow to and from the heat source can be controlled. In the preferred form of the plates, each of the notches has a depth of about one-half the width of the plate as measured between the side edges and end section 40 has a length approximately twice the "width" of the corresponding notch. However, other depth-to-width ratios can be used without departing from the scope of the disclosure, and the notches need not be right triangles.

Figure 2:
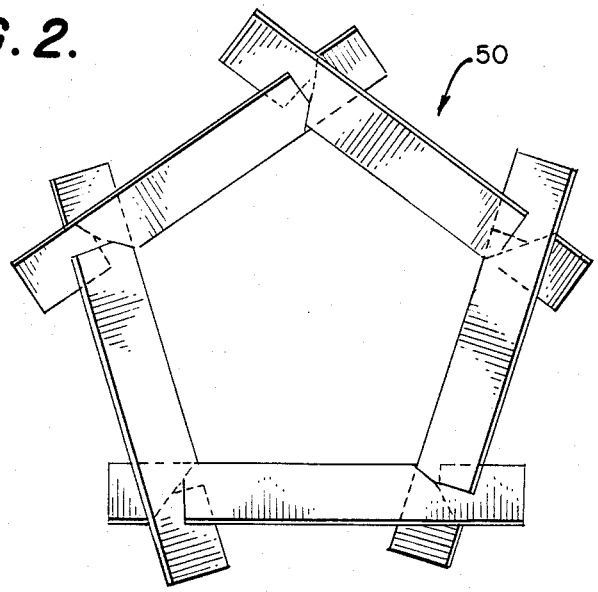
FIG. 2 is a top plan view of a multi-sided portable, knockdown field stove embodying the present invention, and also has phantom lines indicating a closed bottom structure.
Figure 3:
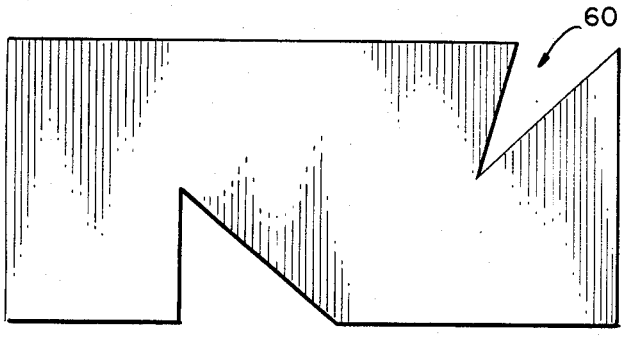
FIG. 3 is a plate used to vary the tilt of one plate with respect to other plates included in a field stove.

As indicated in FIG. 2, a plurality of plates can be interconnected to form a multi-sided frusto-pyramidical field stove, such as the six-sided stove 50 shown in FIG. 2. The depth, shape and orientation of the notches can be adjusted to vary the angle of tilt as indicated for notch 60 of plate 61 in FIG. 3.

Figure 4:
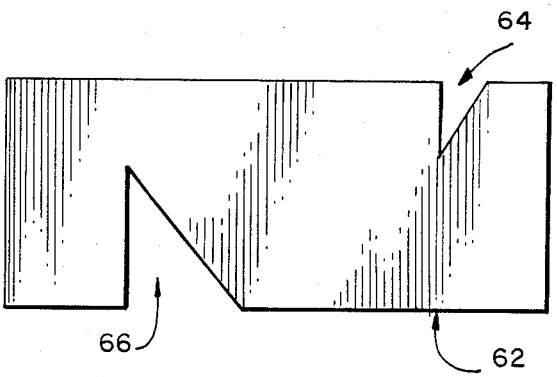
FIG. 4 is a plate suitable for forming a rectangular field stove.

Shown in FIG. 4 is a plate 62 having right triangular notches 64 and 66 defined therein. Notch 66 is larger than notch 64 and plate 62 is suitable for forming a rectangular field stove in which all four sides thereof inwardly and downwardly.

Figure 5:
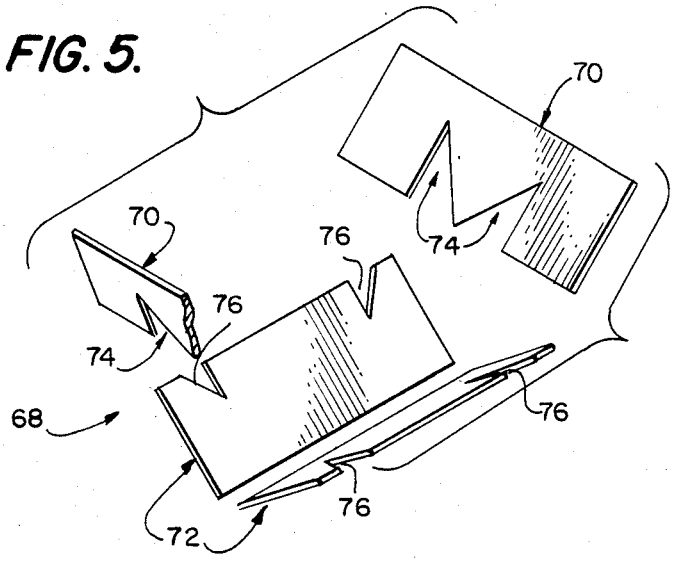
FIG. 5 is an exploded perspective of a rectangular portable, knockdown field stove.

Another rectangular field stove 68 is shown in FIG. 5. Stove 68 includes identical end plates 70 and identical side plates 72. Each of the end plates 70 includes a pair triangular slots 74 oriented to form a capital letter M and which are sized to cooperate with triangular slots 76 defined in side plates 72. The slots 76 are shaped so side plates 72 are tilted to be downwardly convergent toward each other for supporting a fuel source above the ground and for properly resolving the weight-generated forces. The notches 76 are preferably right triangle-shaped and can also be sloped to cause end plates 70 to tilt to be downwardly convergent toward each other, or shaped to maintain end plates 70 to be essentially vertically disposed, as suitable. As before, the notches are all sized and located to define protected ventilation paths for the stove. Stove 68 is also suitable for use with a rectangular heat source.

Figure 6:
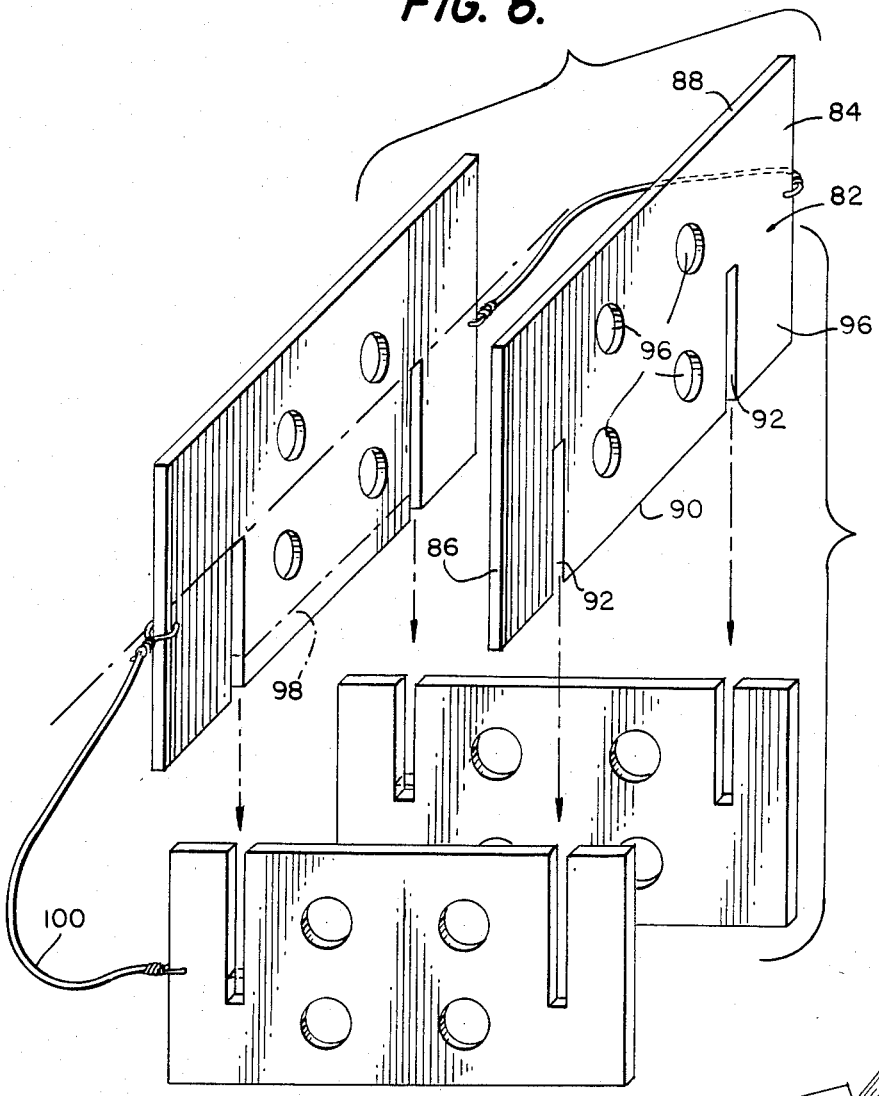
FIG. 6 is an exploded perspective of another rectangular, portable, knockdown field stove.

Shown in FIG. 6 is another rectangular stove 80 formed of four identical, planar plates 82. The plates are rectangular with end edges 84 and 86 connected together by side edges 88 and 90, with a pair of identical slots 92 defined therein to extend from side edge 90 inwardly of the plate. The slots extend for less than one-half the width of the plate so a ventilation path can be defined between side edge 90 and the ground. Vent holes 96 are also defined in the plates.

The vent holes are sized according to the size of the ventilation path so a heat source is properly ventilated. Each slot is spaced inwardly from an end edge a distance of about three times the width of the slot so an end section 96 is formed which acts as a wind shield for the vent holes and ventilation path. A slot 98 can also be defined in each plate to extend from one slot to the other to enlarge the ventilation path, if suitable.

Rectangular field stove 80 is particularly suitable for military use, as the fuel source commonly used by the military is rectangular in shape. A tether means 100 can be used to keep the plates 82 together.

Figure 7:
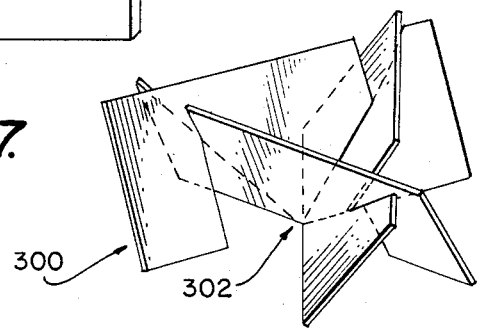
FIG. 7 shows an embodiment of the invention having a closed bottom.

Shown in FIG. 7 is a further alternative embodiment of the stove indicated by reference numeral 300 wherein bottom portion 302 is closed for the purpose of preventing the heat source from contacting the ground.

INDUSTRIAL APPLICABILITY

The field stove disclosed herein can be formed of aluminum or other solid non-flammable material or metal which can be coated with non-reflecting material is suitable, and is as suitable for use in Arctic or mountainous environments with high winds and temperatures as low as −40 F. as it is in temperate, planar environments or in jungle environments with temperatures over 100 F. The stove can be used with any suitable heat source, such as a charcoal briquette or a trioxane fuel bar, or the like. The plates can be packaged with the fuel source and provided as a kit if suitable. The tilt of the interlocked plates can be varied to adjust the amount of ventilation for the stove to produce a desired burn. Thus, one or more plates can be tilted more than the remaining plates to vary the size of one or more of the openings adjacent the plate joints with respect to the size of the remaining joint openings so one portion of the heat source burns more rapidly than other portions, thus producing a desired rate of heat generation for the stove. Such adjustment can be used to compensate for wind conditions as well, or to accommodate an uneven utensil being supported on the stove by varying the degree of support provided at different locations about the perimeter of the stove. The degree of plate tilt can also be adjusted to accommodate heat sources of various sizes and shapes as well as to move a heat source toward or away from a utensil as desired. The tether 100 can be used in conjunction with any of the field stoves disclosed herein. A reflecting means, such as the foil wrapper of the heat source, or the like, can be placed under the field stove to reflect heat back toward the utensil and to help support the stove. This heat would otherwise be lost, and there is little danger to the reflecting means as the heat source is supported by the plates and thus does not contact that reflecting means. This is especially advantageous when the field stove is used on snow or ice. The amount of tilt of the plates can be adjusted to produce a closed bottom, as indicated in phantom lines in FIG. 2, therefore producing a pyramidical shape as opposed to a frusto-pyramidical shape produced by an open bottom stove such as stove 10 in FIG. 1.

Other embodiments can include a stove which is modified to use as a fuel source a canned source or fuel such as Sterno TM or some other canned solid, gelatinous or fluid fuel. This modification can be effected by including an arcuate cut-out in edge 18 of plate means 16 in FIG. 1. In such a modification the can of fuel rests on the ground and the stove fits around the can and also rests on the ground. Other shapes of canned fuel can be similarly accomodated.

I claim:

1. A portable, knockdown field stove for supporting a cooking utensil above a portable heat source comprising:

a plurality of interlockable elongated plate means for enclosing and supporting the portable heat source above ground, interlocking and ventilating means in each plate means for disengagably interlocking said each plate means to another plate means and defining a vent at the location of interlocking to provide a predetermined amount of ventilation to and from the portable heat source to support and sustain a predetermined rate of combustion of the portable heat source, said interlocking and ventilating means further including triangular notch means defined in each plate means to extend inwardly from a side edge of said each plate means for causing each plate means to tilt with respect to another plate means interlocked therewith so interlocked plate means converge toward each other and toward the ground at an angle for supporting said portable heat source on said plate means above the ground and for resolving forces generated by the weight of the cooking utensil in a manner which increases interlocking forces of said stove.

2. The field stove defined in claim 1 wherein all of said plate means are identical.

3. The field stove defined in claim 2 wherein each of said notche means extends for approximately one-half the width of each plate means as measured between the side edges thereof.

4. The field stove defined in claim 1 wherein at least one of said notch means is in the form of a right triangle.

5. The field stove defined in claim 1 wherein said plate means are interlocked to form a multi-sided frusto-pyramidical structure.

6. The field stove defined in claim 1 wherein said plate means contact each other to form a closed bottom for the stove.

7. The field stove defined in claim 1 wherein said plate means form a closed bottom.

* * * * *